US009462837B2

(12) United States Patent
Ngo

(10) Patent No.: US 9,462,837 B2
(45) Date of Patent: Oct. 11, 2016

(54) METHOD OF APPLYING ARTIFICIAL EYELASHES TO AN EYELID AND AN ASSEMBLY THEREFOR

(71) Applicant: Vina Lien Thi Ngo, Vancouver (CA)

(72) Inventor: Vina Lien Thi Ngo, Vancouver (CA)

( * ) Notice: Subject to any disclaimer, the term of this patent is extended or adjusted under 35 U.S.C. 154(b) by 0 days.

(21) Appl. No.: 14/691,157

(22) Filed: Apr. 20, 2015

(65) Prior Publication Data

US 2015/0296914 A1 Oct. 22, 2015

Related U.S. Application Data

(60) Provisional application No. 61/982,149, filed on Apr. 21, 2014.

(51) Int. Cl.
*A41G 5/02* (2006.01)

(52) U.S. Cl.
CPC ..... *A41G 5/02* (2013.01)

(58) Field of Classification Search
CPC ..... A41G 5/02
USPC ..... 132/201
See application file for complete search history.

(56) References Cited

U.S. PATENT DOCUMENTS

| | | | | |
|---|---|---|---|---|
| 1,831,801 | A * | 11/1931 | Birk | A41G 5/02 132/53 |
| 1,897,719 | A | 2/1933 | Birk | |
| 2,829,655 | A | 4/1958 | Bau | |
| 8,113,218 | B2 | 2/2012 | Nguyen | |
| 8,225,800 | B2 * | 7/2012 | Byrne | A41G 5/02 132/216 |
| 2005/0061341 | A1 * | 3/2005 | Choe | A41G 5/02 132/53 |
| 2008/0196732 | A1 | 8/2008 | Merszei | |
| 2010/0080766 | A1 | 4/2010 | Dumousseaux et al. | |
| 2010/0170526 | A1 | 7/2010 | Nguyen | |
| 2010/0319721 | A1 | 12/2010 | Pays et al. | |
| 2011/0253156 | A1 | 10/2011 | Harley et al. | |
| 2012/0247497 | A1 | 10/2012 | Zhang et al. | |
| 2012/0301417 | A1 | 11/2012 | Pays et al. | |
| 2013/0068242 | A1 | 3/2013 | Green | |
| 2013/0133681 | A1 | 5/2013 | Chipman | |

FOREIGN PATENT DOCUMENTS

| | | |
|---|---|---|
| CA | 2620443 | 3/2007 |
| CA | 2758663 | 10/2009 |
| CA | 2807301 | 2/2012 |

* cited by examiner

*Primary Examiner* — Eduardo C Robert
*Assistant Examiner* — Brianne Kalach
(74) *Attorney, Agent, or Firm* — Cameron IP

(57) ABSTRACT

There is also provided a method of applying artificial eyelashes on an eyelid. The method includes forming a cluster of artificial eyelashes which are splayed and coupled together at a first end thereof. The method includes coupling the first end of the cluster of artificial eyelashes to the eyelid. The method includes at least partially attaching a plurality of individually spaced-apart artificial eyelashes on top of the cluster of artificial eyelashes. There is further provided an assembly of artificial eyelashes for a peripheral portion of an eyelid. The assembly includes a plurality of clusters of artificial eyelashes. Each of the clusters of artificial eyelashes is splayed and includes artificial eyelashes coupled together at one end. The ends of the clusters of artificial eyelashes are connectable to the peripheral portion of the eyelid. The assembly includes a plurality of individually spaced-apart artificial eyelashes overlying the cluster of artificial eyelashes.

9 Claims, 10 Drawing Sheets

METHOD OF APPLYING ARTIFICIAL EYELASHES TO AN EYELID AND AN ASSEMBLY THEREFOR

CROSS REFERENCE TO RELATED APPLICATIONS

This application is a non-provisional of U.S. Provisional Patent Application No. 61/982,149 filed in the United States Patent and Trademark Office on Apr. 21, 2014, and the disclosure of which is incorporated herein by reference and priority to which is claimed.

BACKGROUND OF THE INVENTION

1. Field of the Invention

This invention pertains to the field of beauty products. More particularly, the invention relates to a method of applying artificial eyelashes to an eyelid and an assembly therefor.

2. Description of the Related Art

Numerous inventions have been created with the objective of enhancing beauty. One feature of the face that may tend to enhance or detract from a person's perceived beauty are the eyes and in particular, the eyelashes. For example, mascara or similar compositions such as keratinous material may be used to give the eyelashes a thicker appearance and in some cases even add length to existing lashes. In addition, some may receive eyelash extensions, often with the trained assistance of a lash technician at a professional salon. Lash technicians or other trained professionals may add lash extensions by the usually-painstaking process of joining each artificial lash to a person's real eyelash, one lash at a time. This method may not lend itself to a do-it-yourself approach because it is difficult to connect individual artificial eyelashes to one's own respective individual natural eyelashes. Also, different compositions or bonding agents may be used to join the artificial lashes to the real lashes, some of which (like superglue) may be harmful to the body. Costs for eyelash extensions from professional are furthermore often imposed in an ongoing manner since such eyelash extensions may fall off and are rarely permanent. Individual artificial eyelashes may be coupled to respective individual natural lashes at lash salons and when the artificial eyelashes fall out, there may be an increased chance of the corresponding natural lashes also falling out.

Partly due to the costs imposed for professionally-done artificial eyelash extensions, "do-it-yourself" eyelash extension kits have been created with the objective of allowing persons to place eyelash extensions on themselves. However, for various reasons, most such eyelash extension kits entail drawbacks. For example, a person attempting to by themselves attach each artificial lash extension to each real lash will often be frustrated, as this can be a difficult process requiring a high degree of concentration and hand-eye coordination (and this while the eyelids are repeatedly being touched). Considering the number of eyelashes and how many eyelash extensions are required in order to achieve a natural and attractive look by such a process, joining each eyelash extension with a real eyelash may require a long period of time.

As a result, some prior art eyelash extension kits suggest adding small clusters of lashes attached to one another, such as "flare" lashes, directly to the lower or upper eyelid, using some sort of bonding agent such as glue. However, often such prior art group lashes, while easier to attach than joining each eyelash extension to an individual real eyelash, fail to sufficiently achieve an optimal level of natural-looking attractiveness. This may be due in part to the disparity in appearance between the flared lashes and the real lashes. In addition, possibly in recognition of such disparity, some prior art eyelash extension articles and methods may utilize a backing with a curved surface that may be attached to an eyelid, upon which individual artificial lashes may be joined.

BRIEF SUMMARY OF INVENTION

There is provided an improved method of applying artificial eyelashes and assembly therefor disclosed herein that may overcome the above disadvantages.

Described and shown herein is a method and articles that may overcome at least some of the aforementioned drawbacks. For example, described and shown herein are embodiments of a process and articles allowing one user alone to place eyelash extensions in a simpler and relatively expeditious manner that results in a satisfactory natural look. More particularly, in one embodiment, flared lashes may be joined to the eyelid, or rather to the natural lashes found substantially on the person's eyelid, as a base or bedding for the individual artificial lashes. If necessary, the different single lashes of the flared lash may be spread out and then the individual artificial lashes (not part of the flared lash) may be individually added to the flared lashes (or added to both the flared lashes and the person's natural lashes together). This may occur, by example, if an individual lash comprises both a distal and a proximal end, by dipping the proximal end and the area above the proximal end in glue, and then joining the substantially proximal end to the flared lash and/or the natural lash(es).

In one embodiment, the flared lashes may comprise varying lengths to be strategically placed on sections of the eyelid according to length. For example, dividing the areas of eyelid into three sections, an inner section closer to the nose, a middle section, and an outer section, flared lashes of a shorter length may be joined to the inner section of the eyelid, flared lashes of a longer length may be joined to the middle section of the eyelid, and flared lashes of a medium length (having a length longer than the shorter length but shorter than the longer length) may be added to the middle section. In one particular embodiment, the shorter length, the longer length, and the medium length may be respectively 8 millimeters (and/or under 8 millimeters), 12 millimeters, and 10 millimeters. However, it is anticipated that embodiments may vary in lengths; for example in one embodiment the 8 millimeter could be used in all three sections, basically running all the way across the eyelid. Although flared lashes may be placed on either the natural lashes of the upper or the lower eyelid, it is anticipated that placement on the upper eyelid will be preferred.

As mentioned above, individual artificial eyelashes may then be joined to the flared lashes (and/or the natural lashes) that have been placed along the eyelid(s), and likely attached to the natural lashes. The individual artificial eyelashes may preferably have an appearance (color, texture, thickness, length, etc.) complementary to the flared lashes, and may be strategically placed along the flared lashes in manners that will be apparent to users of ordinary skill. In one embodiment, the length of such artificial individual lashes may, but is not required to, somewhat follow a similar pattern to that of the flared lashes where lashes with shorter lengths are found in the inner section of the eyelid, longer lengths in the middle section, and medium lengths in the outer section. In one embodiment, possible lengths of individual artificial eyelashes may range from 6 millimeters to 16 millimeters (e.g., 8 mm, 10 mm, 12 mm, 14 mm, 15 mm). For example, 8 mm lashes may be added in the corner of the eyelid, or the inner section, 14 mm lashes may be added to the middle section, and lashes ranging in length from 10-12 mm may be added to the outer section.

Thus, embodiments of the invention shown and described herein may permit the user herself to control to an extent the manner and degree to which the artificial eyelashes are added. For example, the user may control the amount of eyelashes she desires to attach. In some embodiments, it is anticipated that the artificial eyelashes, so added, may last for about two to three weeks. Although the process may then be repeated, embodiments of the process may be relatively non-complex and expeditious, thus saving a user time and money, and avoid the hassle of making an appointment to visit a salon to receive professional assistance, without substantially sacrificing quality in degree of natural look. Nevertheless, it is anticipated that embodiments may also have application for some professionals.

In some embodiments, a bonding agent (e.g., glue) that is non-irritant and not harmful to the skin (such as tender eyelid skin) and to the eyes may be preferred, as well as bonding agent remover (e.g. glue remover) with similarly non-harmful qualities. An eyelash comb may also provide assistance with application.

There is accordingly provided a method for placing artificial eyelashes on an eyelid having some natural eyelashes. The artificial eyelashes includes clustered artificial eyelashes that are splayed and coupled together at first ends thereof and individual artificial eyelashes. The method includes the step of placing the clustered artificial eyelashes on the eyelid so that the clustered artificial eyelashes are attached to the natural eyelashes. The method includes the step of at least partially attaching at least some of the individual artificial eyelashes to the clustered artificial eyelashes.

There is also provided a method of applying artificial eyelashes on an eyelid. The method includes forming a cluster of artificial eyelashes which are splayed and coupled together at a first end thereof. The method includes coupling the first end of the cluster of artificial eyelashes to the eyelid. The method includes at least partially attaching a plurality of individually spaced-apart artificial eyelashes on top of the cluster of artificial eyelashes.

There is further provided an assembly of artificial eyelashes for a peripheral portion of an eyelid. The assembly includes a plurality of clusters of artificial eyelashes. Each of the clusters of artificial eyelashes is splayed and includes artificial eyelashes coupled together at one end. The ends of the clusters of artificial eyelashes are connectable to the peripheral portion of the eyelid. The assembly includes a plurality of individually spaced-apart artificial eyelashes overlying the cluster of artificial eyelashes.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 2:
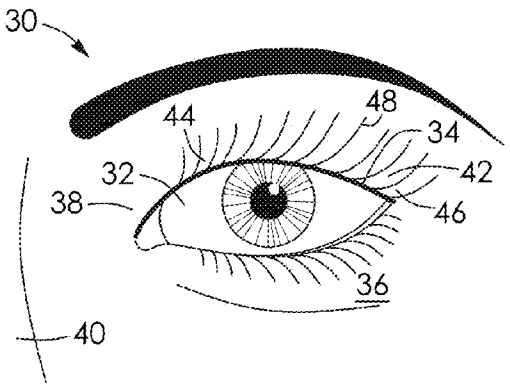
FIG. 2 is a front elevation view similar to FIG. 1 showing the person's left eye, with the upper eyelid being shown in a raised position and the person's natural eyelashes having been cleaned in preparation for adding artificial eyelashes.
Figure 1:
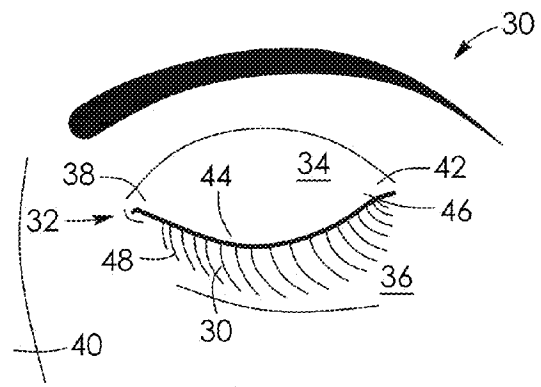
FIG. 1 is a front elevation view of a person's face shown in fragment, the person's face having a left eye with bare, natural eyelashes and eyelids in closed positions which extend over the eye.

Referring to the drawings, and first to FIG. 1, there is shown a person 30 having a left eye 32. The person has an upper eyelid 34 and a lower eyelid 36 spaced-apart below the upper eyelid. The upper eyelid has an inner section 38 which is adjacent to the nose 40 of the person 30. The upper eyelid 34 also has an outer section 42 which is spaced-apart from the inner section and which is adjacent to the person's ear (not shown). The upper eyelid also has a middle section 44 interposed between the inner and outer sections. The upper eyelid 34 has a generally horizontally-extending peripheral portion or lash line 46 which is positioned adjacent to the lower eyelid 36 when the eyelids are in their closed positions seen in FIG. 1. Natural eyelashes, or bare lashes 48 extend from the lash line 46 of the upper eyelid. FIGS. 1 and 2 show the person with only their natural eyelashes and no artificial eyelashes connected thereto.

Eyelid 34 and lashes 48 are cleaned, and then artificial eyelashes may be added. This method embodiment may comprise several steps, not necessarily in the following order.

Figure 3:
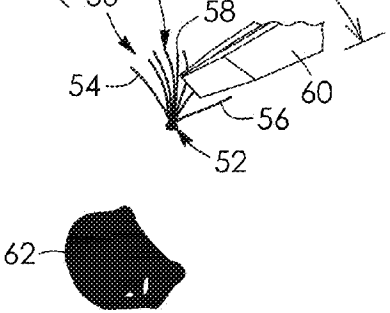
FIG. 3 is a front perspective view of a cluster of artificial eyelashes which are splayed and coupled together at a first end thereof, the cluster being shown held by tweezers, shown in fragment, and the cluster being shown spaced-apart from a fluid adhesive which has not yet set.

The method includes the use of a plurality of flared lashes or clusters of artificial eyelashes as seen in FIG. 3 as cluster 50 of artificial eyelashes. Each cluster is fan-shaped and may thus also be referred to as a fanned lash. Each cluster 50 has a first end 52 and a second end 53 which is spaced-apart from its first end. Each cluster is splayed and the artificial eyelashes thereof are coupled together at the first end 52 thereof via a knot in this example. The artificial eyelashes of each cluster include peripheral lashes 54 and 56 and a central lash 58 which is interposed between the peripheral lashes. Each cluster 50 is fan-shaped or v-shaped in this example and may be held by tweezers 60. In this example, each cluster of artificial eyelashes is shaped such that the peripheral lashes 54 and 56 are shorter than the central lash 58; however this is not strictly required and the lashes of the cluster may have the same length in other examples. Each cluster 50 may be referred to also as clustered artificial eyelashes.

The method may include spreading outwardly apart the lashes of each cluster using tweezers for example. Referring to FIG. 3, each cluster 50 has an angular span extending between its peripheral lashes 54 and 56 that is equal to an angle $\alpha$. Angle $\alpha$ is equal to an angle in the range of 60 and 180 degrees in one preferred example. Angle $\alpha$ is equal to an angle in the range of 110 and 180 degrees in a more preferred example. Angle $\alpha$ is equal to an angle in the range of 110 and 150 degrees in yet a more preferred example.

Figure 4:
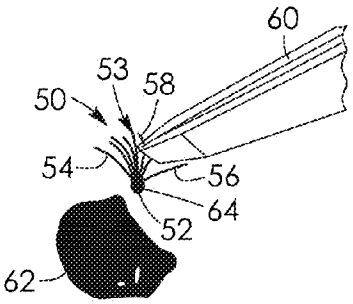
FIG. 4 is a front perspective view similar to FIG. 3 showing the cluster of artificial eyelashes held by tweezers and spaced-apart from the adhesive, with a globule of the adhesive coating the first end of the cluster of artificial eyelashes.

The method of applying artificial lashes to a person's eyelid includes the step of dipping the first ends 52 of the clusters 50 into a liquid adhesive, in this example, glue 62 which has not yet set. This causes a globule 64 of glue to coat the end 52 as seen in FIG. 4.

Figure 5:
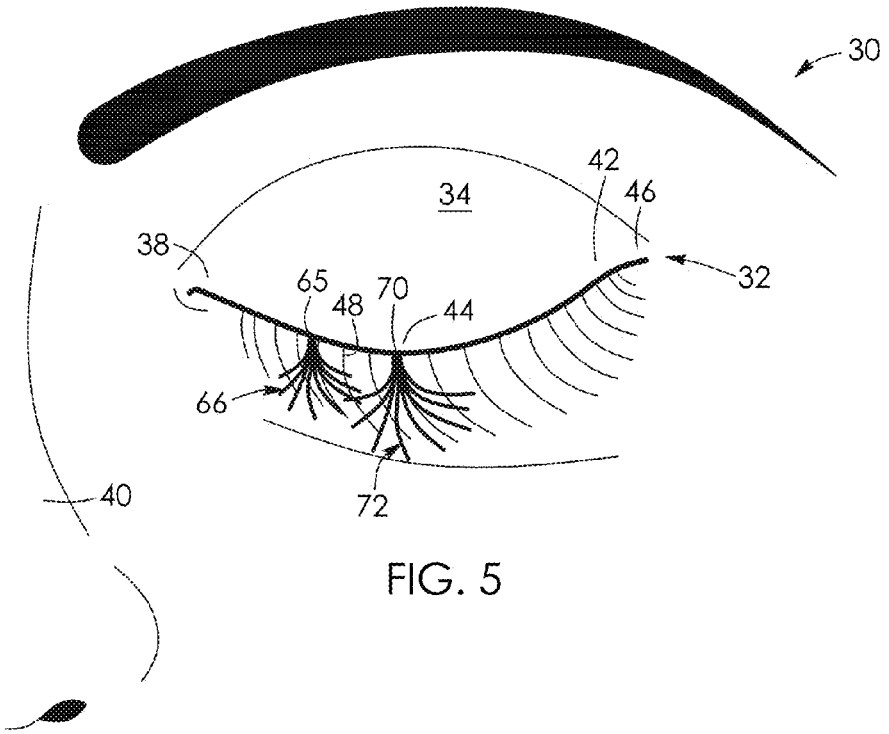
FIG. 5 is a front elevation view similar to FIG. 1 showing the person's left eye, with the eyelid shown in the closed position, with the first end of a 8 mm-length cluster of artificial eyelashes similar to that shown in FIG. 4 shown adhering to the inner section of the upper eyelid at a peripheral portion thereof, and the first end of a 12 mm-length cluster of artificial eyelashes similar to that shown in FIG. 4 adhering to the middle section of the upper eyelid at the peripheral portion thereof, the 12-mm length cluster being positioned to the right of the 8 mm-length cluster from the perspective of FIG. 5.
Figure 6:
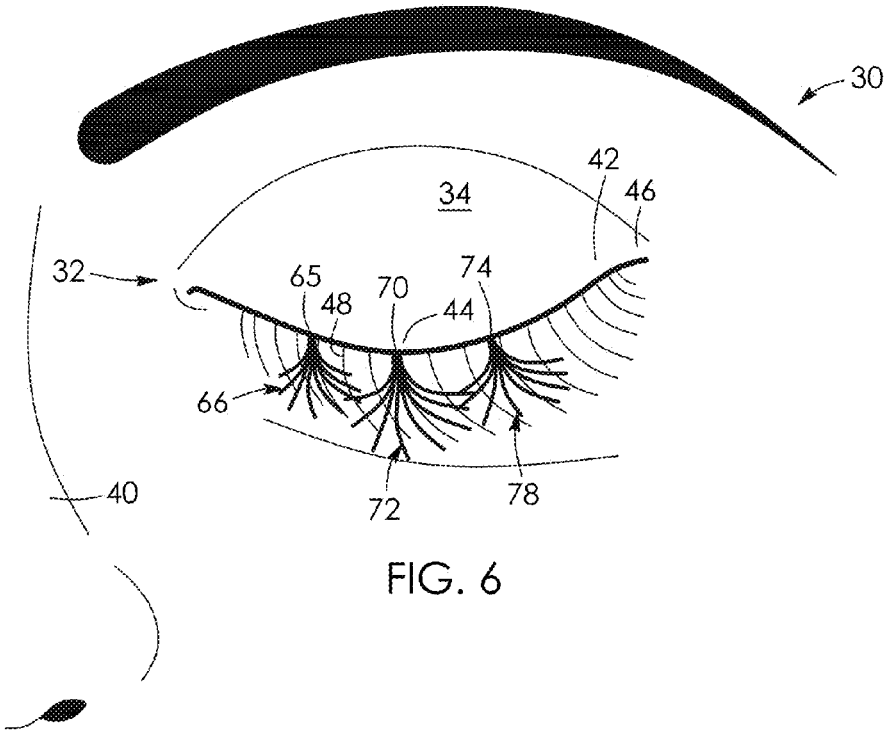
FIG. 6 is a front elevation view similar to FIG. 5 showing the person's left eye, with the eyelid shown in the closed position and with the first end of a first 10 mm-length cluster of artificial eyelashes similar to that shown in FIG. 4 adhering to the outer section of the upper eyelid at the peripheral portion thereof, the first 10 mm-length cluster being shown to the right of the 12 mm-length cluster from the perspective of FIG. 6.
Figure 7:
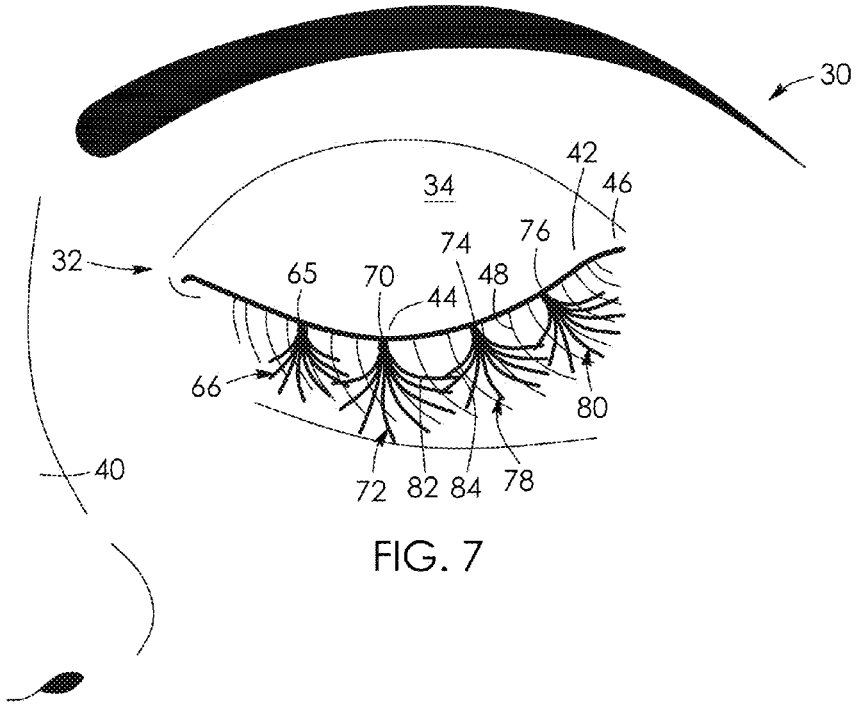
FIG. 7 is a front elevation view similar to FIG. 6 showing the person's left eye, with the eyelid shown in the closed position and with the first end of a second 10 mm-length cluster of artificial eyelashes similar to that shown in FIG. 4 adhering to the outer section of the upper eyelid at the peripheral portion thereof, the second 10 mm-length cluster being shown to the right of the first 10 mm-length cluster from the perspective of FIG. 7.

As seen in FIGS. 5 to 7, the method of applying the artificial eyelashes includes coupling the first ends 52 of the clusters 50 of artificial eyelashes to the lash line 46 of the upper eyelid 34. In this example, and referring first to FIG. 5, the first end of clustered artificial eyelashes of shorter lengths, in this example in the form of first end 65 of a flared lash 66, is coupled to the inner section 38 of the upper eyelid 34. The flared lash has an average length of 8 mm in this example. Lash 66 is preferably positioned adjacent to the inside corner 68 of the eye 32 adjacent to nose 40.

Still referring to FIG. 5, the first end of clustered artificial eyelashes of longer lengths, in this example in the form of first end 70 of a flared lash 72, is coupled to the middle section 44 of the eyelid 34. The flared lash 72 has an average length of 12 mm in this example. Flared lash 72 is positioned to the right of flared lash 66 in this example. Both flared lashes 66 and 72 attach via adhesive to the natural lashes 48 of the eyelid 34 in this example.

As seen in FIGS. 6 and 7, the first ends of a pair of clustered artificial eyelashes of medium lengths, in this case in the form of first ends 74 and 76 of a first and second pair of flared lashes 78 and 80, are coupled to the outer section 42 of the eyelid 34. Flared lashes 78 and 80 have an average length of 10 mm in this example. Both flared lashes 78 and 80 attach via adhesive to the natural lashes 48 of the eyelid 34 in this example, with flared lash 78 being to the right of flared lash 72 and flared lash 80 being to the right of flared lash 78 from the point of view of FIG. 7. Each of the first ends 65, 70, 74 and 76 of respective ones of the flared lashes are spaced-apart from adjacent ones of the ends along the eyelid by a distance equal to or greater than 4 mm in this example. The flared lashes 66, 72, 78 and 80 may also be spread in a more webbed manner prior to being applied to the lash line 46 of the eyelid 34 according to preference.

The peripheral lashes of adjacent ones of the flared lashes abut, overlap and interweave with each other in this example, as seen in FIG. 7 by adjacent peripheral lashes 82 and 84 of flared lashes 72 and 78, respectively.

Figure 8:
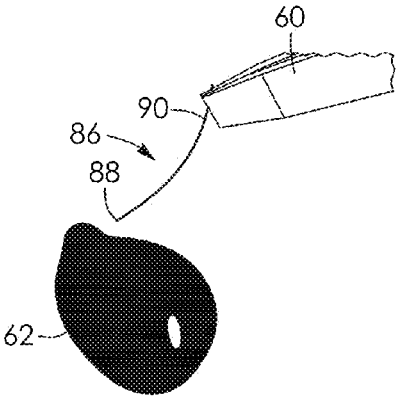
FIG. 8 is a front perspective view of an individual artificial eyelash shown held by tweezers shown in fragment and being shown spaced-apart from fluid adhesive which has not yet set.
Figure 9:
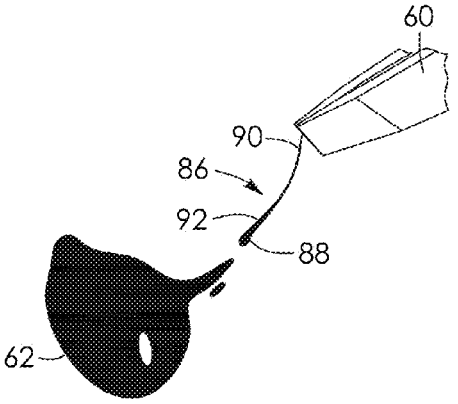
FIG. 9 is a front perspective view similar to FIG. 8 showing the individual artificial eyelash held by tweezers and spaced-apart from the adhesive, with a globule of the adhesive coating a portion of the artificial eyelash.

The method of applying artificial eyelashes includes the use of a plurality of individually spaced-apart artificial eyelashes, shown in FIG. 8 as individual artificial eyelash 86. Each of the individual eyelashes has a first end portion 88 and a second end portion 90 which is spaced-apart from the first end. The second end is held by tweezers 60 in this example. The method of applying artificial lashes to a person's eyelid includes the step of dipping the first end portions 88 of respective ones of the individually spaced-apart artificial eyelashes 86 into a liquid adhesive, in this example, glue 62 which has not yet set. This causes a coating 92 of glue to extend around the end portion 88 as seen in FIG. 9.

Figure 10:
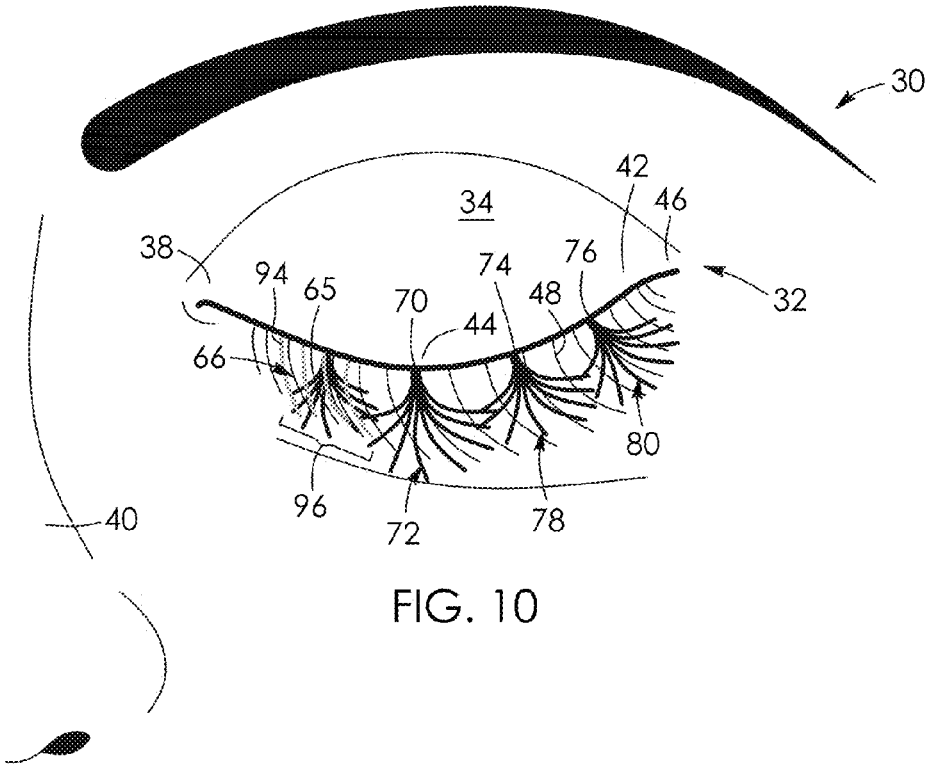
FIG. 10 is a front perspective view similar to FIG. 7 showing the person's left eye, with 8 mm-length individual artificial eyelashes similar to that shown in FIG. 9 adhering to the inner section of the eyelid at the peripheral portion thereof and being positioned at least partially overtop of the 8 mm-length cluster of artificial eyelashes located in the inner section of the eyelid.
Figure 11:
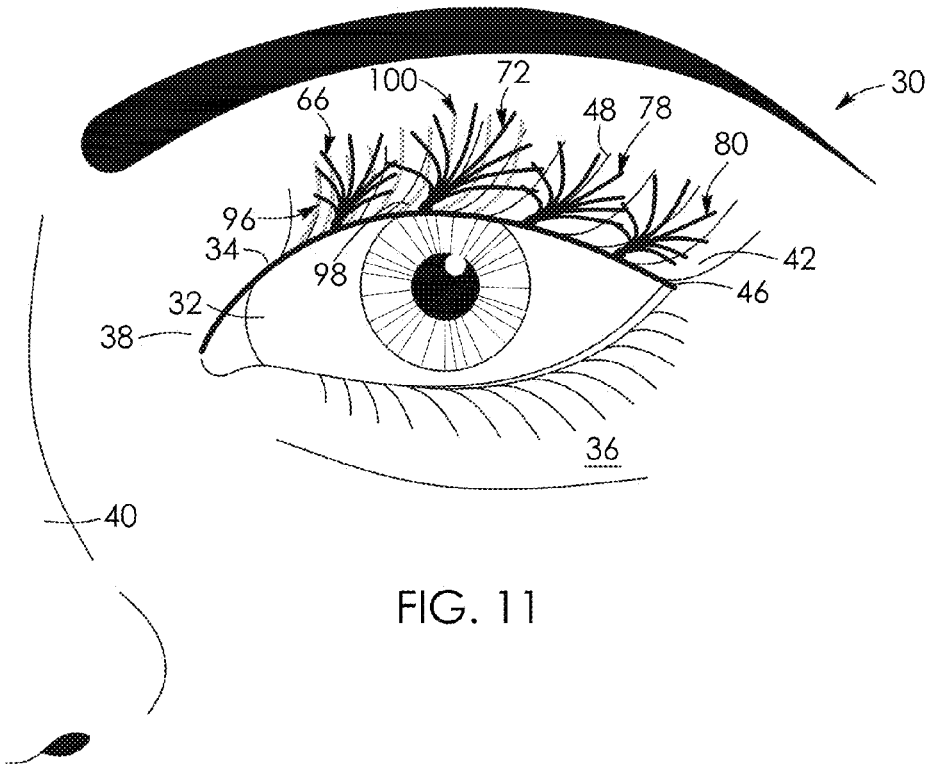
FIG. 11 is a front perspective view similar to FIG. 10 showing the person's left eye, with the upper eyelid being shown in a raised position and with 10 mm-length individual artificial eyelashes similar to that shown in FIG. 9 adhering to the middle section of the eyelid at the peripheral portion thereof and being positioned at least partially overtop of the 12 mm-length cluster of artificial eyelashes located in the middle section of the eyelid.
Figure 12:
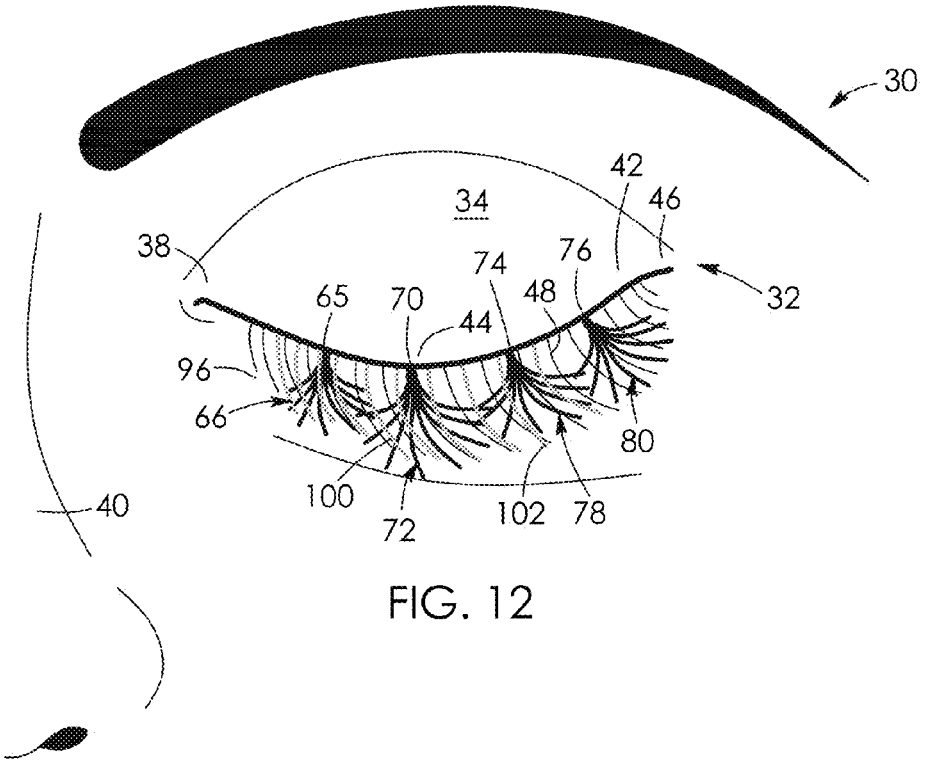
FIG. 12 is a front perspective view similar to FIG. 11 showing the person's left eye, with the eyelids being shown in closed positions and with 10 mm-length individual artificial eyelashes similar to that shown in FIG. 9 adhering to the outer section of the eyelid at the peripheral portion thereof and being positioned at least partially overtop of the first 10 mm-length cluster of artificial eyelashes located in the outer section of the eyelid.

Referring to FIG. 10, the method of applying artificial eyelashes includes the step of at least partially attaching at least some of the individual artificial eyelashes to the flared lashes. In this example, the first end portions 94 of individual lashes 96, having lengths of 8 mm may be placed adjacent to the inner section 38 of the eyelid 34 and overlie and attach to flared lash 66 and/or the natural lashes 48. As seen in FIG. 11, the first end portions 98 of individual lashes 100, having lengths of 10 mm may be placed in the middle section 44 of the eyelid 34 and overlie and attach to the flared lash 72 and/or the natural lashes 48.

Figure 13:
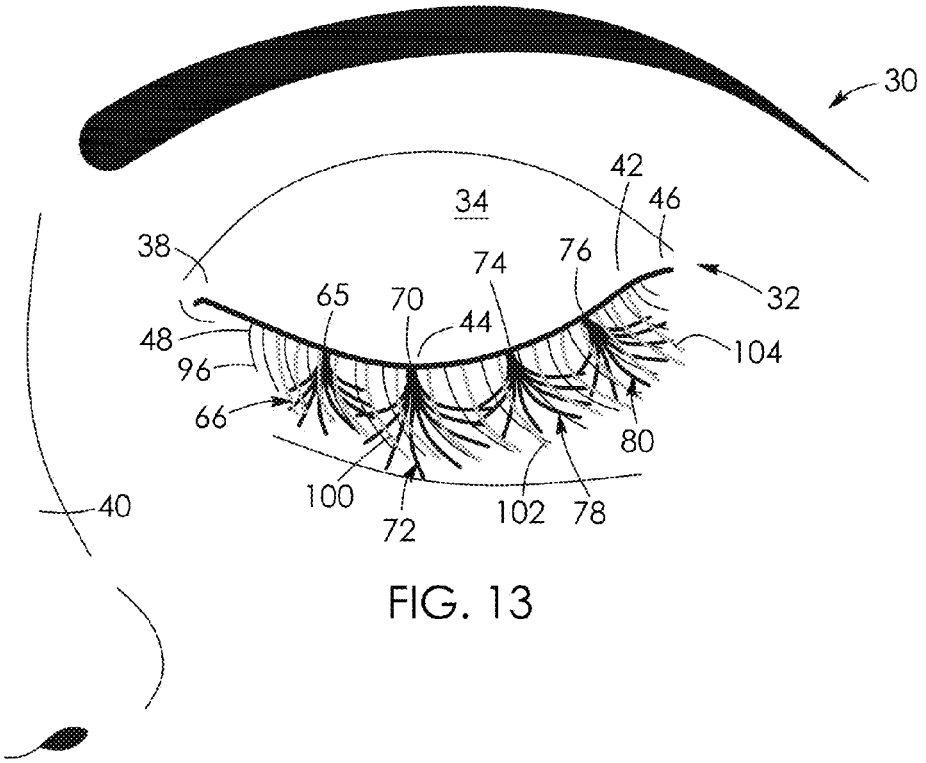
FIG. 13 is a front perspective view similar to FIG. 12 showing the person's left eye, with the eyelids being shown in closed positions and with 10 mm-length individual artificial eyelashes similar to that shown in FIG. 9 adhering to the outer section of the eyelid at the peripheral portion thereof and being positioned at least partially overtop of the second 10 mm-length cluster of artificial eyelashes located in the outer section of the eyelid.
Figure 14:
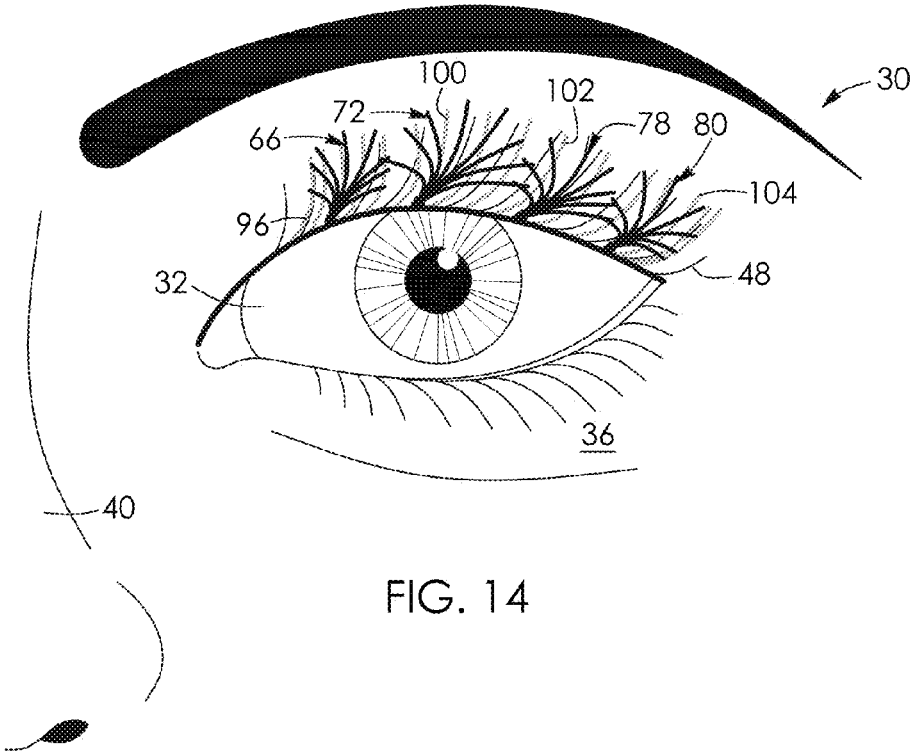
FIG. 14 is a front perspective view similar to FIG. 13 showing the person's left eye, with the upper eyelid being shown in a raised position.

As seen in FIG. 13, other individual artificial eyelashes 102 and 104 may be placed in the outer section 42 of the eyelid and overlie and attach to the flared lashes 78 and 80, respectively. Alternatively, individual artificial eyelashes 102 and 104 may overlie and attach to the natural lashes 48. As a further alternative, individual artificial eyelashes 102 and 104 may be placed in the outer section 42 of the eyelid and overlie and attach to the flared lashes 78 and 80, respectively, and also attach to the natural lashes 48.

Figure 15:
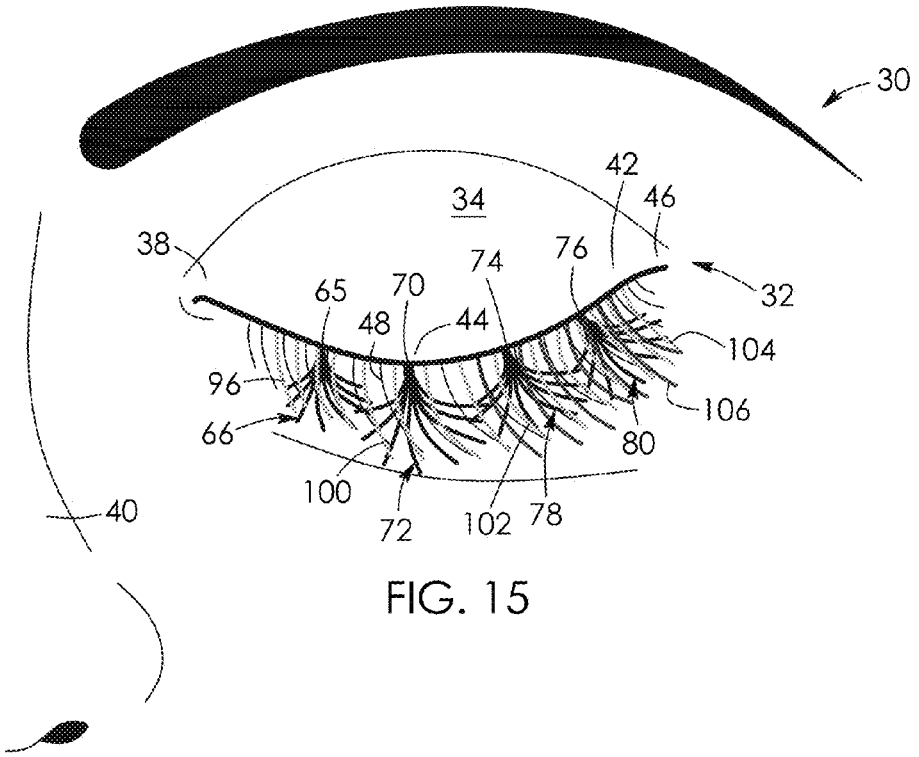
FIG. 15 is a front perspective view similar to FIG. 14 showing the person's left eye, with the eyelids being shown in closed positions and with 12 mm-length individual artificial eyelashes similar to that shown in FIG. 9 being placed in the outer section of the eyelid at the peripheral portion thereof and not necessarily onto the 12 mm-length cluster of artificial eyelashes located in the middle section of the eyelid.
Figure 16:
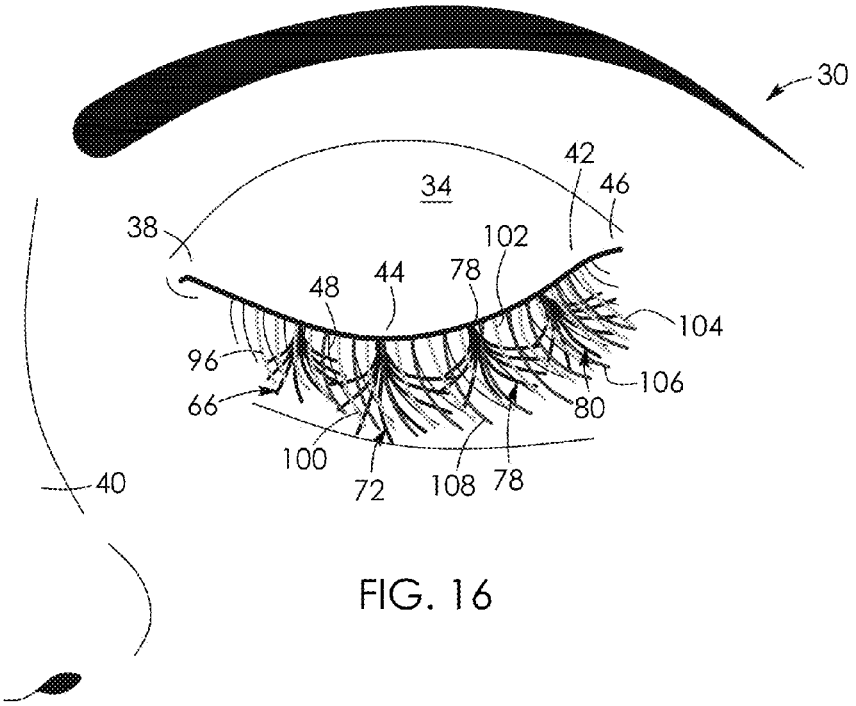
FIG. 16 is a front perspective view similar to FIG. 15 showing the person's left eye, with the 12 mm-length individual artificial eyelashes being placed in a layered manner over the 10 mm-length individual artificial eyelashes located in the middle section of the eyelid at the peripheral portion thereof and not necessarily onto the 12 mm-length cluster of artificial eyelashes located in the middle section of the eyelid.
Figure 17:
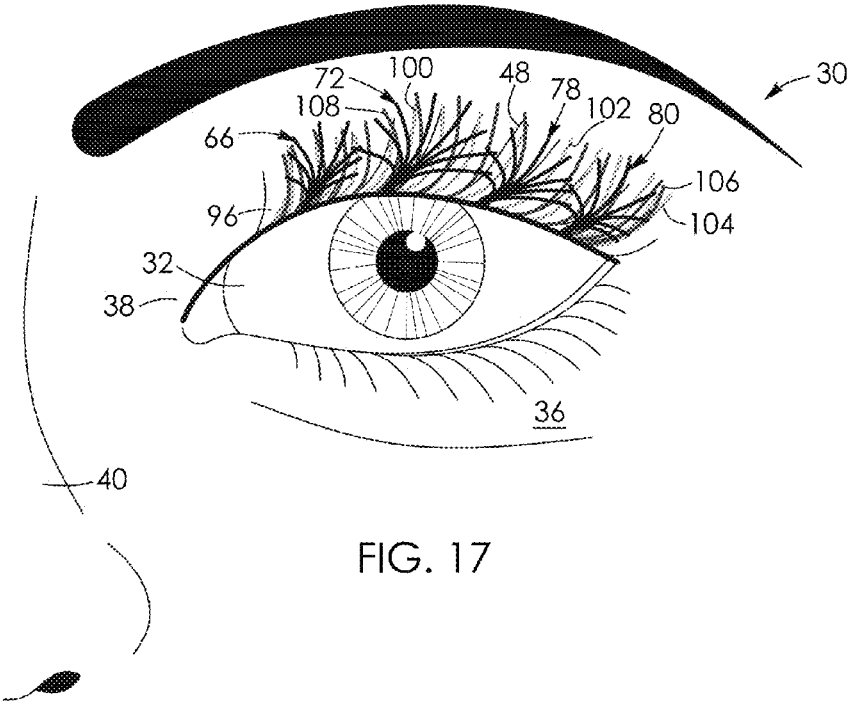
FIG. 17 is a front perspective view similar to FIG. 16 showing the person's left eye, with the upper eyelid being shown in a raised position.
Figure 18:
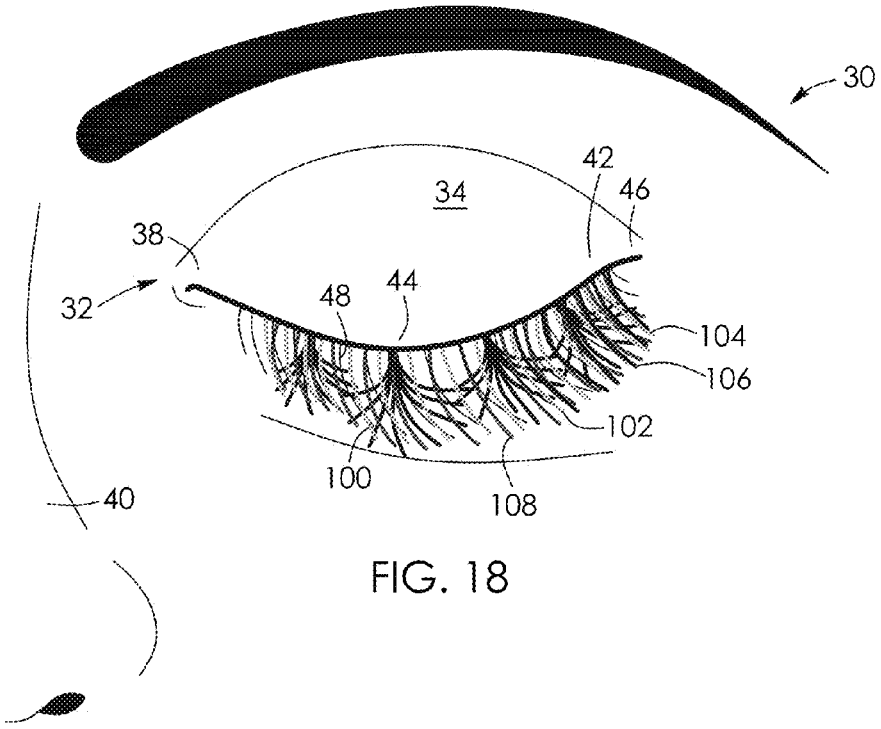
FIG. 18 is a front perspective view similar to FIG. 16 showing the person's left eye, with the 12 mm-length individual artificial eyelashes being placed in a layered manner over the 10 mm-length individual artificial eyelashes located in the outer section of the eyelid and not necessarily onto the 10 mm-length cluster of artificial eyelashes located in the outer section of the eyelid.
Figure 19:
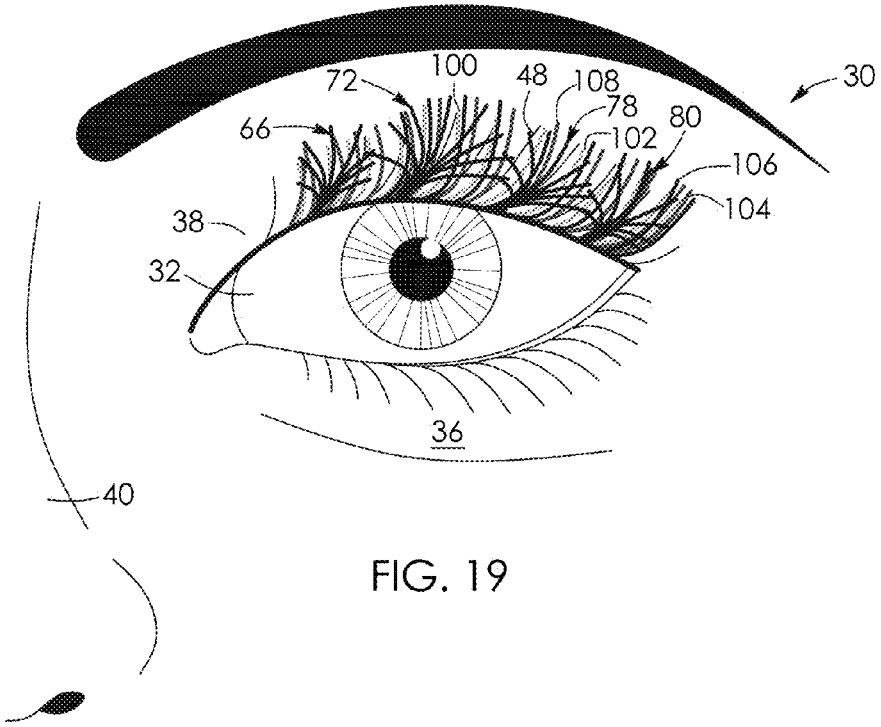
FIG. 19 is a front perspective view similar to FIG. 18 showing the person's left eye, with the upper eyelid being shown in a raised position.

Next, as shown in FIG. 15, additional individual artificial eyelashes 106, which in this example have lengths of 12 mm, may also be placed in the outer section 42 of the upper eyelid 34. Similarly, as shown in FIGS. 16 to 19, further individual artificial eyelashes having lengths of 12 mm may also be placed on the eyelid 34 in a layered manner over the individual lashes 31 that are already attached to the rest of the flared lashes 78 and 80, the additional lashes being indicated by numeral 108. Alternatively, lashes 108 having lengths of 12 mm may be placed on the eyelid 34 in a layered manner over the natural lashes 48 in both the middle section 44 and outer section 42 of the eyelid 34. As a further alternative, lashes 108 may be placed on the eyelid 34 in a layered manner over the individual lashes 31 that are already attached to the rest of the flared lashes 78 and 80 and also placed on the eyelid 34 in a layered manner over the natural lashes 48 in both the middle section 44 and outer section 42 of the eyelid 34.

Figure 20:
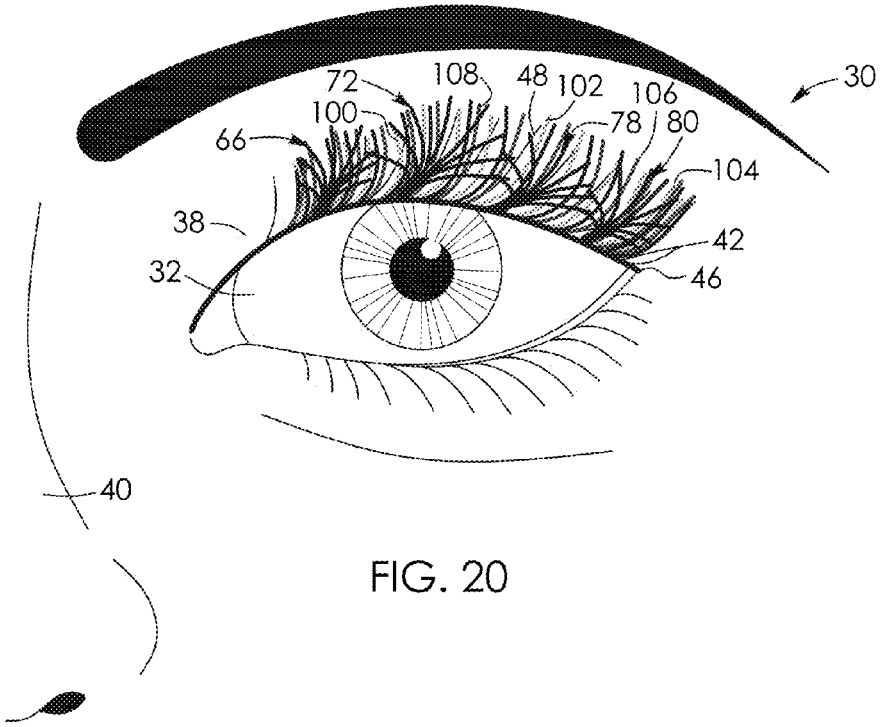
FIG. 20 is a front perspective view similar to FIG. 19 showing the person's left eye, with yet additional individual artificial eyelashes have been placed over the inner, middle, and outer sections of the upper eyelid at the peripheral portion thereof.

The steps of adding individual artificial eyelashes in such a manner may be repeated according to preference and desire. The individual lashes may be added throughout any or all sections of the eyelid 34, as shown in FIG. 20. This may be achieved without having to attach the individual artificial lashes one at a time to person's own natural lashes 48. The flared lashes 66, 72, 78 and 80 described herein, together with the individually spaced-apart artificial eyelashes overlying on the top thereof and coupled thereto may be said to comprise an assembly 110 of artificial eyelashes for the lash line 46 of an eyelid 34.

Figure 21:
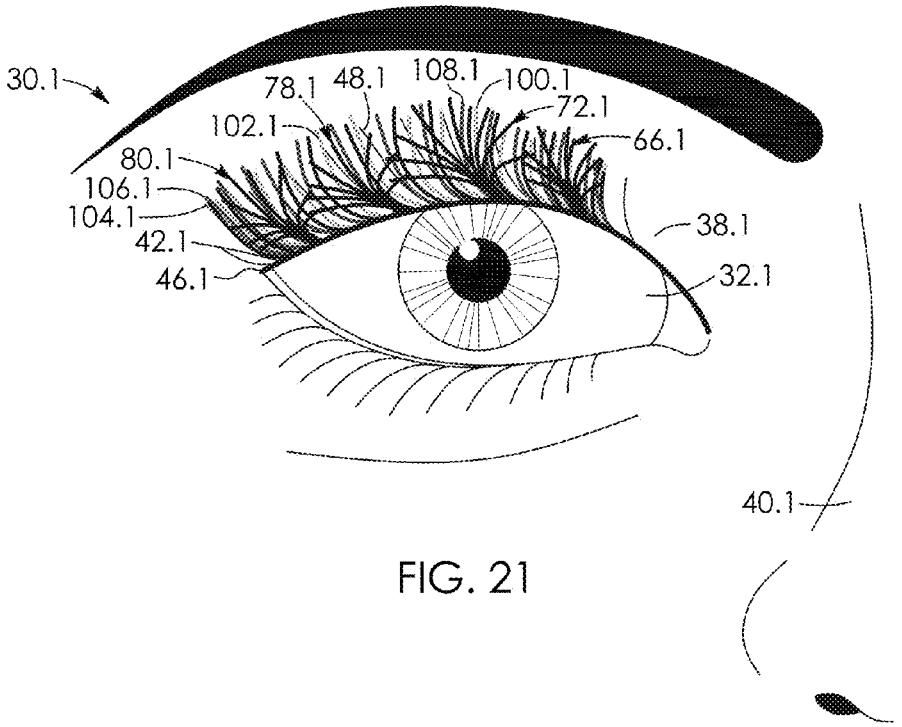
FIG. 21 is a front perspective view similar to FIG. 20 showing the person's right eye, with artificial eyelashes placed on the upper eyelid thereof in a manner similar to that shown in FIGS. 1 to 20.

The same or variations of the above-described method embodiment may also be followed for adding artificial lashes to the upper eyelid 34.1 of the right eye 32.1, as shown in FIG. 21. Like numbers for eye 32.1 have like numbers and parts as eye 32 shown in FIG. 20 with the addition of decimal extension "0.1".

Although FIGS. 1, 5 to 7, 10, 12, 13, 15, 16 and 18 show the upper eyelid 34 in a closed position, it is anticipated that when person 30 is coupling the artificial eyelashes to an eyelid, it will normally be in an open position. The method of applying artificial eyelashes as herein described is thus performed with the eyes open according to one preferred embodiment. FIGS. 1, 5 to 7, 10, 12, 13, 15, 16 and 18 show the upper eyelid in the closed position for the purposes of illustration only to show among other things another view of the artificial lashes.

The clusters 66, 72, 78 and 80 of artificial lashes as herein described may thus function as a support system upon which may be placed further individual artificial lashes.

Figure 22:
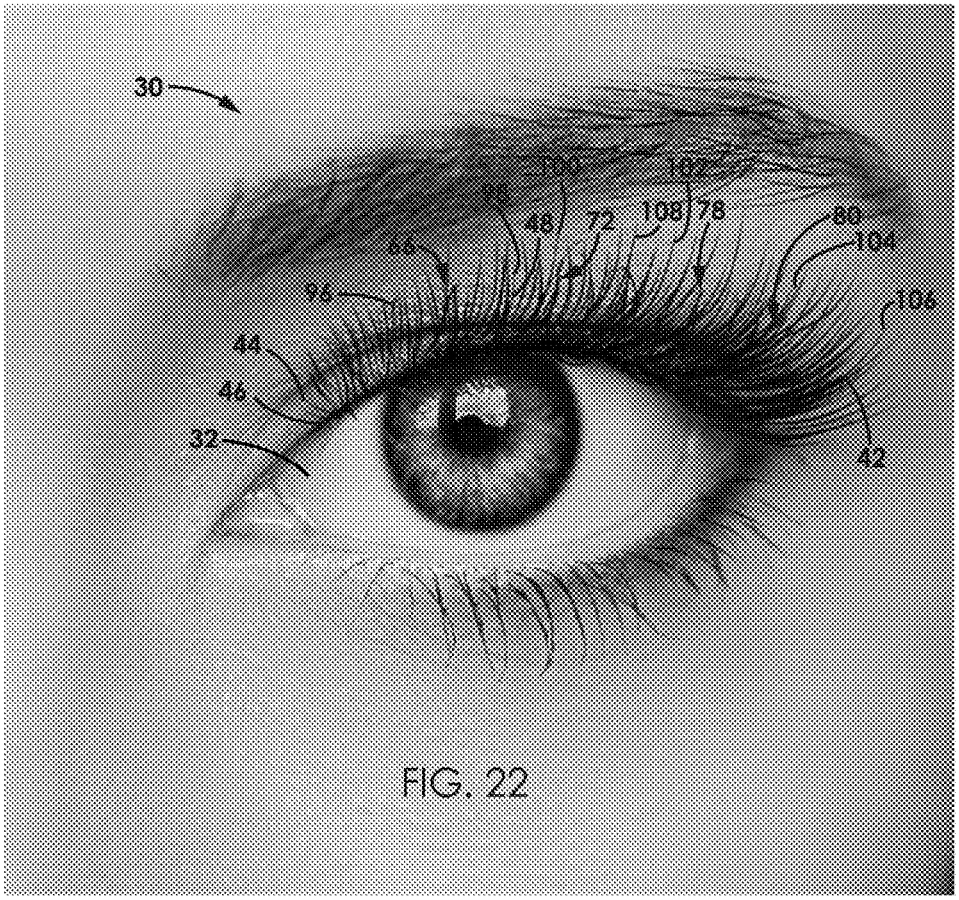
FIG. 22 is a photograph similar to FIG. 19 showing the person's left eye and the flared and individual artificial eyelashes shown in FIG. 20 connected to the eyelid of the eye.

FIGS. 1 to 21 are schematic versions of the eyelashes described herein and are considerably simplified for the purposes of explanation and clarification. FIG. 22 is an example of a photo a person's eyelid with the artificial eyelashes shown in FIG. 20 attached thereto, the flared and individual artificial lashes being applied thereon according to the description herein.

FIG. 22 shows an example of how assembly 110 actually appears. The clusters 66, 72, 78 and 80 of artificial lashes so spread out blend in with the rest of the lashes and are thus camouflaged.

The assembly and method as herein described enables one to apply the artificial lashes by one's self, and may result in a person with fuller eyelashes that appear natural. The assembly and method as herein described may thus replicate the look otherwise obtained by a lash salon, for example, while inhibiting damage to the underlying natural lashes.

It will be appreciated that many variations are possible within the scope of the invention described herein. For example, FIGS. 7 to 22 include four clusters 66, 72, 78 and 80 of artificial eyelashes; however, this is not strictly required, as only three clusters may be used in other embodiments.

It will be understood by someone skilled in the art that many of the details provided above are by way of example only and are not intended to limit the scope of the invention which is to be determined with reference to at least the following claims.

What is claimed is:

1. A method of applying artificial eyelashes to a lash line of an eyelid, the method comprising:

forming a cluster of artificial eyelashes which are splayed and coupled together at a first end thereof;

coupling said first end of the cluster of artificial eyelashes to the lash line of the eyelid; and at least partially attaching a plurality of individual artificial eyelashes directly to the lash line of the eyelid at spaced apart intervals, the individually spaced-apart artificial eyelashes overlying on top of the cluster of artificial eyelashes.

2. The method as claimed in claim in claim 1, the eyelid having at least some naturally-occurring eyelashes, and the method further comprising:

overlying the cluster of artificial eyelashes on said at least some naturally-occurring eyelashes.

3. The method as claimed in claim 1, wherein, within the coupling step, the method comprising coupling the first end of the cluster of artificial eyelashes to the lash line of the eyelid with adhesive.

4. The method as claimed in claim 1, the cluster of artificial eyelashes having peripheral lashes and a central lash interposed between the peripheral lashes, the method further comprising within the forming step:

shaping the cluster of artificial eyelashes such that the peripheral lashes are shorter than the central lash.

5. The method as claimed in claim 1, the eyelid including a peripheral portion, the peripheral portion having an inner section, an outer section and a middle section between the inner and outer sections, and the method comprising:

forming an additional plurality of clusters of artificial eyelashes, each of which is splayed and coupled together at its respective first end thereof;

coupling the first end of a first one of the clusters of artificial eyelashes to the inner section of the peripheral portion of the eyelid, the first end of a second one of the clusters of artificial eyelashes to the middle section of the peripheral portion of the eyelid, and the first end of a third one of the clusters of artificial eyelashes to the outer section of the peripheral portion of the eyelid; and at least partially attaching an additional plurality of individually spaced-apart artificial eyelashes on top of the additional plurality of clusters of artificial eyelashes.

6. The method as claimed in claim 5, each of the clusters of artificial eyelashes having peripheral lashes, and the method further comprising:

coupling the clusters of artificial eyelashes along the peripheral portion of the eyelid such that the peripheral lashes of the second one of the clusters of artificial eyelashes abut with adjacent ones of the peripheral lashes of the first one and the third one of the clusters of artificial eyelashes.

7. The method as claimed in claim 5, each of the clusters of artificial eyelashes having peripheral lashes, and the method further comprising:

coupling the clusters of artificial eyelashes along the peripheral portion of the eyelid such that the peripheral lashes of the second one of the clusters of artificial eyelashes overlap with adjacent ones of the peripheral lashes of the first one and the third one of the clusters of artificial eyelashes.

8. The method as claimed in claim 5, the method further comprising within the forming step:

selecting artificial eyelashes for the second one of the clusters which are longer than those of the first one and the third one of the clusters of artificial eyelashes.

9. The method as claimed in claim 1, the method further comprising:

forming additional clusters of artificial eyelashes which are splayed and coupled together at respective first ends thereof;

coupling the first ends of the additional clusters of artificial eyelashes to the lash line of the eyelid such that the first ends of respective ones of the clusters of artificial eyelashes are spaced-apart from each other along the lash line of the eyelid by a distance equal to or greater than 4 mm; and at least partially attaching an additional plurality of individually spaced-apart artificial eyelashes on top of the additional clusters of artificial eyelashes.

* * * * *